US005804023A

United States Patent [19]

Carpenter et al.

[11] Patent Number: 5,804,023

[45] Date of Patent: Sep. 8, 1998

[54] LABEL CUTTING AND APPLYING APPARATUS

[75] Inventors: George F. Carpenter, Rockford; Jeffrey A. Engelsman, Hudsonville; Karl J. Burdick, Comstock Park; John T. Doornbos, Grandville; Daniel B. Jones, Wyoming, all of Mich.

[73] Assignee: Grand Rapids Label Company, Grand Rapids, Mich.

[21] Appl. No.: 717,497

[22] Filed: Sep. 20, 1996

[51] Int. Cl.[6] ..... B65C 9/14; B65C 9/18

[52] U.S. Cl. ..... 156/261; 156/264; 156/516; 156/521; 156/566; 156/DIG. 31; 156/DIG. 33; 156/277; 156/387

[58] Field of Search ..... 156/521, DIG. 33, 156/264, 261, 270, 540, 516, 522, 556, 566, DIG. 31, 277, 387

[56] References Cited

U.S. PATENT DOCUMENTS

| | | | |
|---|---|---|---|
| 3,216,297 | 11/1965 | Osborn, Jr. . | |
| 3,823,050 | 7/1974 | Mers | 156/521 X |
| 3,885,705 | 5/1975 | French . | |
| 3,924,504 | 12/1975 | Kurtz . | |
| 4,108,706 | 8/1978 | Brands et al. | 156/DIG. 33 X |
| 4,267,004 | 5/1981 | Anderson . | |
| 4,560,990 | 12/1985 | Sue et al. . | |
| 4,707,211 | 11/1987 | Shibata . | |
| 4,769,110 | 9/1988 | Ohno et al. . | |
| 4,784,714 | 11/1988 | Shibata . | |
| 4,844,771 | 7/1989 | Crankshaw et al. . | |
| 5,040,461 | 8/1991 | Van-Ocker . | |
| 5,099,290 | 3/1992 | Yokota . | |
| 5,188,470 | 2/1993 | Matsubara et al. . | |
| 5,417,783 | 5/1995 | Boreali et al. . | |
| 5,524,996 | 6/1996 | Carpenter et al. . | |

FOREIGN PATENT DOCUMENTS

| | | | |
|---|---|---|---|
| 4201834 | 7/1992 | Japan | 156/DIG. 33 |

*Primary Examiner*—Jeff H. Aftergut
*Attorney, Agent, or Firm*—Rader, Fishman, Grauer & McGarry

[57] ABSTRACT

A label cutting and applying apparatus is arranged to produce printed labels from a continuing strip of label material. By operation of a standard roller, the apparatus advances a strip of the material along a path from a roll of the material over a print head where a portion of the strip is printed. The printed portion is advanced past a cutting blade which is integrally formed with a vertically movable label applicator and is severed from the remainder of the strip by operation of the blade as the applicator moves downwardly. The label applicator can include a vacuum head which then blows the severed label onto a package to apply the label thereto.

6 Claims, 4 Drawing Sheets

LABEL CUTTING AND APPLYING APPARATUS

BACKGROUND OF THE INVENTION

1. Field of the Invention

This invention relates to label printing and applicator apparatus and more particularly to a label printing device with associated label cutter and applicator apparatus.

2. Background Art

A label applicator apparatus for applying preprinted labels to objects such as packages, envelopes, and the like typically includes a print head and a mechanism for advancing a supply of blank labels adjacent the print head. The supply of blank labels typically comprises a roll of discrete, individual labels attached to a continuous backing web, a roll of continuous labels attached to a continuous backing web, or a roll of label material, without a liner. The labels and/or backing are typically advanced past a print head for address printing, bar code printing or the like. After advancing beyond the print head, the labels are typically separated from the backing as needed by advancing the label backing over a label separator bar. If the labels have been supplied as discrete individual labels, they have been typically pre-cut and removably attached to a backing strip using an adhesive. If the labels have been supplied as a continuous web, whether or not a backing strip is included, a discrete length of the label web must be cut from the continuous portion and mounted to a package by a label applicator mechanism. In either case, the cutting step to form one or more discrete label portions adds significant time and expense to the label application process. Expensive special equipment is required to produce a supply of discrete pre-cut labels on a backing sheet, adding significantly to the cost of labels. Furthermore, waste from the label producing operation and the backing sheet must be properly disposed of, further adding to the cost of the label producing process. In addition, a separate cutting mechanism disposed between the print head and the label applicator adds more expense to the cost of application of the labels.

SUMMARY OF INVENTION

These and other problems of the prior art are overcome in accordance with the present invention by providing a method and apparatus for applying labels from a continuous web which includes a component which both cuts a discrete label from the continuous web as well as applying the cut label to a package in a single motion of the machine, thus saving manufacturing costs as well as reducing the amount of time required by the label application process.

In accordance with the present invention, a movable label applicator includes a cutting blade which serves to sever a label portion from the continuous web when the label applicator is actuated. In this manner, the label applicator serves to cut the label and to carry the label toward an object on which the label is to be applied in a single motion. Advantageously, the invention eliminates the need for separate sequently actuated label cutting and label applicator devices. A particular advantage of the invention is increased speed of operation which is obtained by eliminating the prior art step of actuation of label cutter prior to transfer of the printed label to an applicator device.

In one aspect of the invention, the applicator housing includes a rearward curved surface which receives a portion of a printer housing in an abutting relationship which allows the continuous web to be cleanly fed into the applicator for the cutting and applying operations by the body.

In accordance with one aspect of the invention, the applicator includes a slidably mounted body provided with a vacuum head which applies a light vacuum to a printed label portion of the continuous web to retain the label portion on the body. As the body is moved toward the object to be labeled, the vacuum retains the web while the blade severs the label portion from the continuous web and the severed label portion is applied to the object when the vacuum head reaches the object. The vacuum head can comprise a pair of plates mounted to the underside of the body. The first plate comprises a rectangular plate mounted to the underside of the body and having a rectangular recess. The second plate includes several small vacuum ports and is mounted to an outer surface of the first plate. The recess in the first plate is connected to a vacuum source whereby the recess in the first plate acts as a distribution chamber to apply a light vacuum to each vacuum port in the second plate.

In yet another aspect of the invention, the upper surface of the body can include a pair of shafts which extend upwardly and are axially received in a pair of sleeves mounted to the applicator housing. The mounting of the shafts within the sleeves restricts the movement of the body with respect to the housing to substantially vertical motion and prevents the body from binding as it slides therein.

BRIEF DESCRIPTION OF THE DRAWINGS

An embodiment of the invention is disclosed in which.

DETAILED DESCRIPTION

Figure 1:
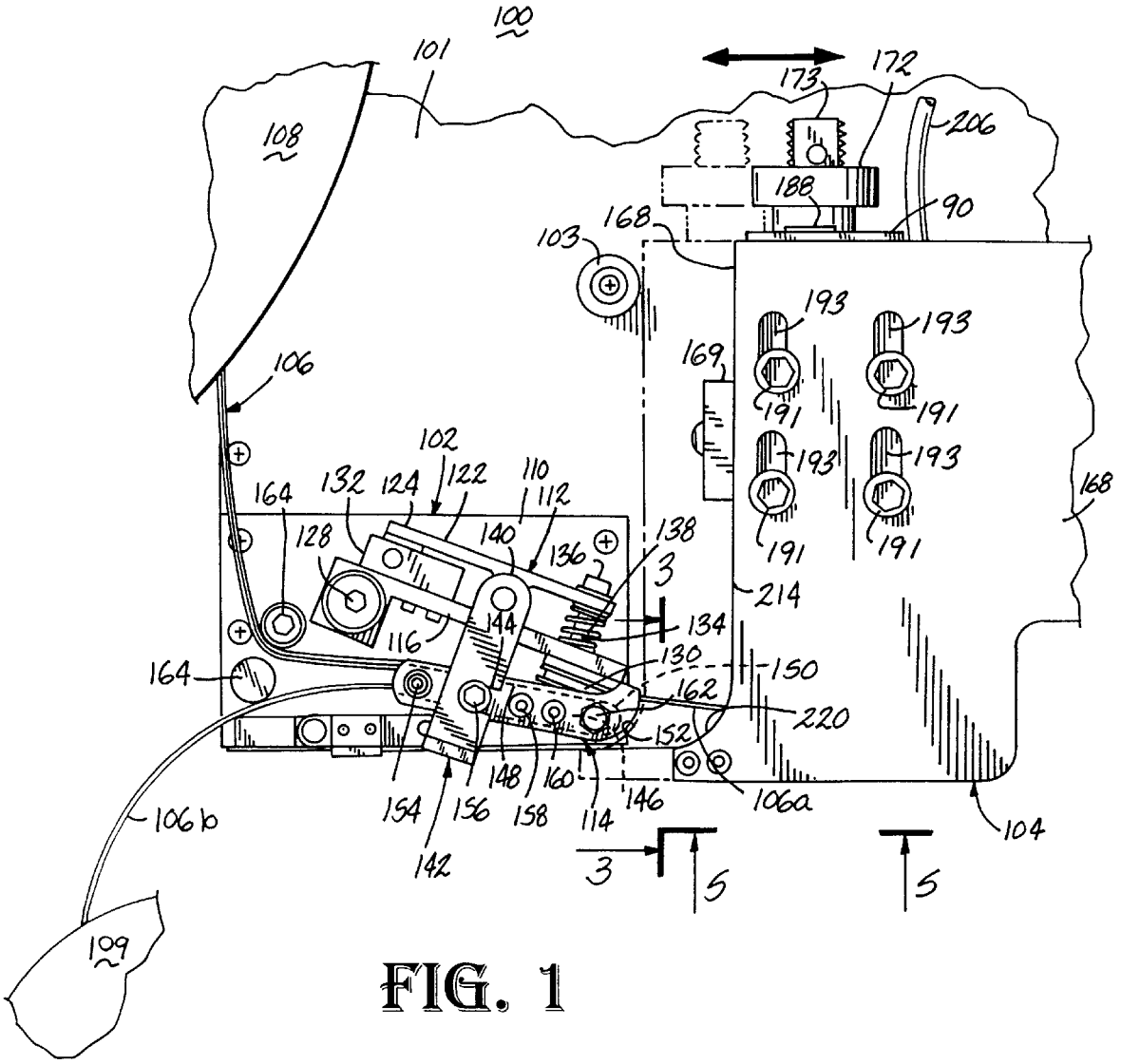
FIG. 1 is a side elevational view of a label cutting and applying apparatus according to the invention.
Figure 4:
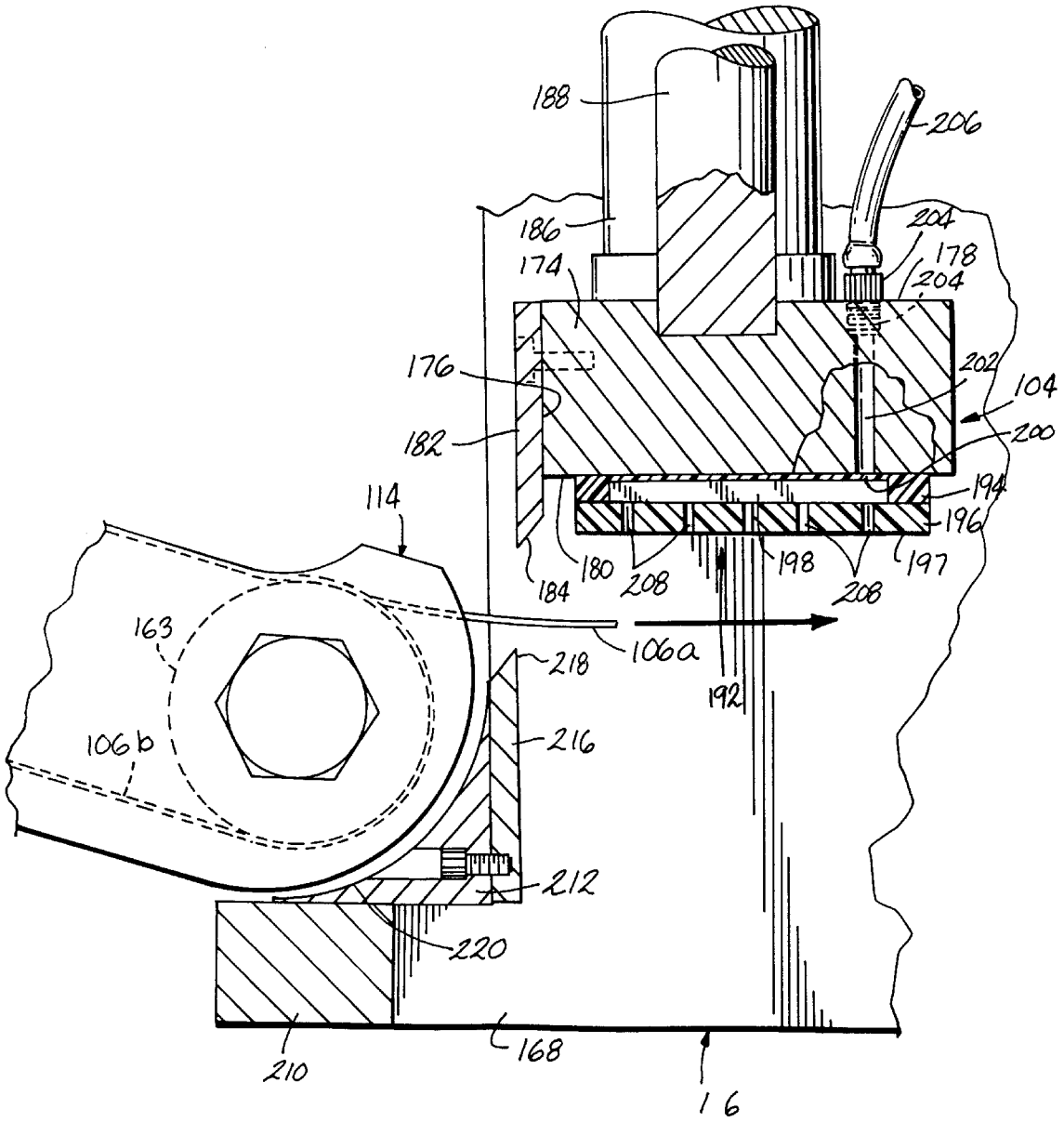
FIG. 4 is an elevational view of the apparatus taken along lines 4—4 of FIG.3.

FIG. 1 shows a label applicator 100 including an exterior housing 101 which mounts a stationary printer 102 and a vertically-movable applicator 104. A continuous web 106 is advanced from a supply spool 108 to the printer 102 which prints label indicia on the web 106. The web 106 is then further advanced into the applicator 104 where the printed portion of the web is retained by a low vacuum carrier applied to the web 106 by a vertically movable cutter/applicator head 174, as depicted in FIG. 4. The head 174 is urged downwardly and the web 106 carried by the head 174 is severed from the remaining web material by a cutting device mounted to the head 174. Following the cutting step, the head 174 is urged further downwardly adjacent an object located below the applicator 104 so that the applicator 104 can transfer the web portion to the object. It will be understood that although the web 106 is shown as a continuous label material 106*a* removably attached to a liner 106*b*, the web 106 can be any material suitable for application to an object and the liner 106*b* is optional.

As shown in FIG. 1, and in greater detail in FIGS. 2–5, the printer 102 comprises a housing 110, a print head unit 112 and a guide plate 114. The print head unit 112 comprises a first elongated member 116 having first and second ends 118 and 120 and a second elongated member 122 spaced apart from the first elongated member and having first and second ends 124 and 126, respectively. The first end 118 of the first elongated member 116 is pivotally mounted to the housing 110 by a fastener 128. The second end 120 of the first elongated member 116 can include a conventional print head 130. The first end 118 of the first elongated member 116 also includes a spacer 132 which pivotally mounts the first end 124 of the second elongated member 122 thereto. The second end 120 of the first elongated member 116 includes a cylindrical shaft 134 extending upwardly from an upper surface thereof which is journaled within an aperture in the second end 126 of the second elongated member 122 and secured therein by a cap 136. A spring 138 biases the second end 120 of the first elongated member 116 with respect to the second end 126 of the second elongated member 122. The second elongated member 122 further includes a central flange 140 which rotatably mounts a latch member 142 having an inwardly-extending notch 144.

The guide plate 114 comprises a body 146 defined by a pair of elongated brackets 148 which rotatably mount several rollers 163. The body 146 has a leading edge 150 and a lower forward edge of the brackets 148 has a curved end surface 152 thereon. The rollers 163 of the body 146 are mounted to the housing 110 by fasteners 154, 156, 158, 160, and 162. In assembly, the guide plate 114 is mounted to the housing 110 so that the leading edge 150 of the body 146 extends slightly beyond a forward edge of the housing 110. The print head unit 112 is pivotally mounted by the fastener 128 so that the notch 144 of the latch member 142 can be pivotally received between a head portion of the fastener 156 and an exterior surface of the bracket 148. The latch member 142 thereby biases the print head 130 toward the body 146 to provide a suitable printing tension thereagainst. The housing 110 can also mount one or more guide rollers 164.

Figure 2:
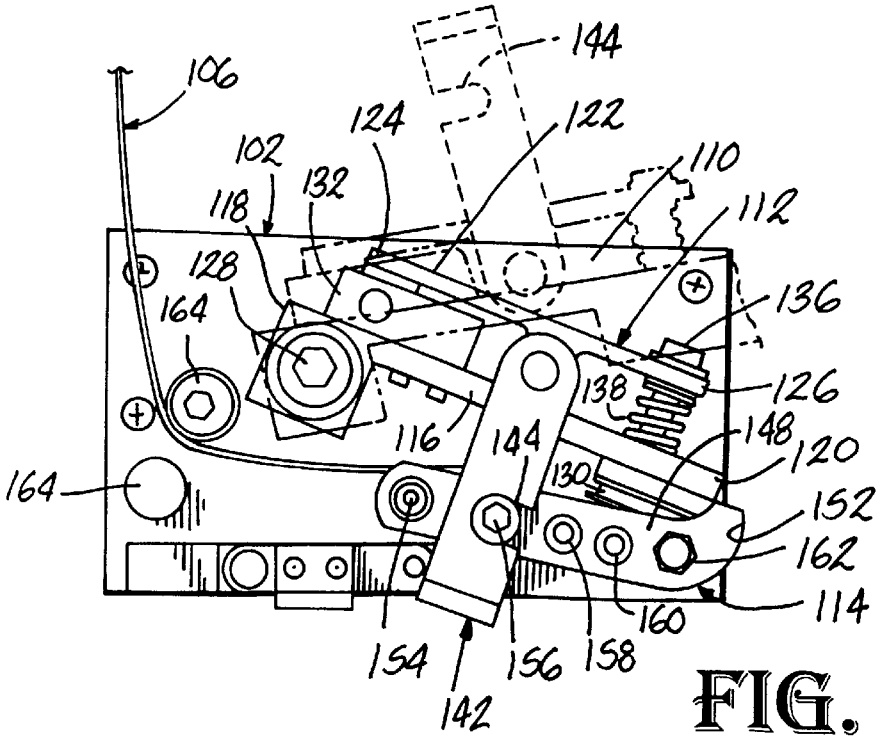
FIG. 2 is a fragmentary side view of a print head element of the apparatus of FIG. 1 shown in a operational position (solid lines) and a retracted position (phantom lines) with the remaining elements of the invention removed for clarity.
Figure 3:
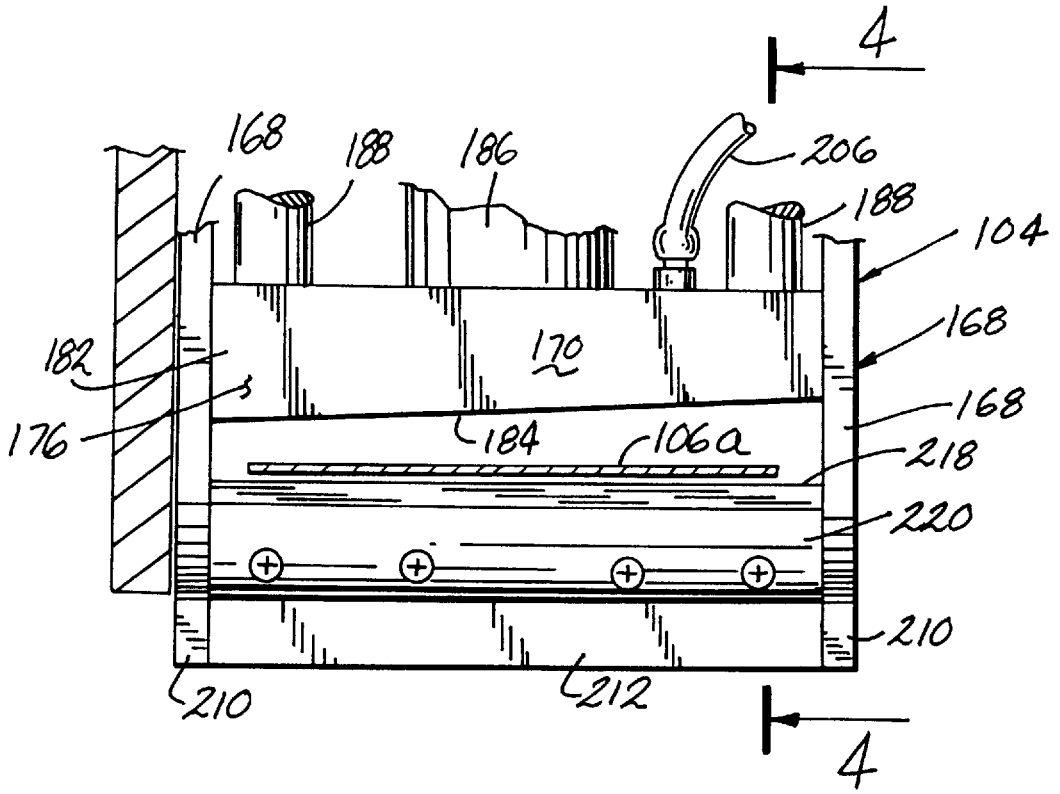
FIG. 3 is a cross sectional view of the apparatus taken along lines 3—3 of FIG. 1.

The web 106 is advanced from the supply spool 108 and along the rollers 163 of the body 146 of the guide plate 114 and, as needed, around the leading edge 150 of the body 146 so that a label portion 106*a* extends outwardly over the leading edge 150 and any liner material 106*b* is fed downwardly against a lower surface of the rollers 163 toward a disposal area (not shown). The label portion 106*a* of the web 106 is received by the print head 130 and can provide any required indicia on the label 106*a* when the latch member 142 is in the operational position as shown in FIGS. 1–2. The latch member 142 can be demounted from the guide plate 114 and pivoted upwardly which allows the print head 130 to be pivoted away from the guide plate 114 as shown in the phantom outline of FIG. 2 to allow for feeding of the web 106 or other repair or service of the printer 102 as needed.

The conventional print head 130 of the printer 102 can be of a type well known in the art. Such prior art print heads are preferably controlled by means of a system controller (not shown), such as a micro-computer or similar control arrangement, to print information specified by an operator, in a well known manner. The web 106 is advanced past the print head 130 to allow a plurality of lines of print to be formed on a section of the label material 106*a*. The print head 130 can be anyone of a number of different types of print heads such as a thermal transfer print head, a dot matrix print head, etc. of types commonly used in label printing operations. After the printing operation, the rollers are operated to advance a leading edge of the web 106. Thereafter, the label portion 106*a* of the web 106 is cut by the applicator 104 from the remainder of the web 106 to form a printed label which is thereafter applied to an object, also by the applicator 104 in a single downward motion.

Figure 5:
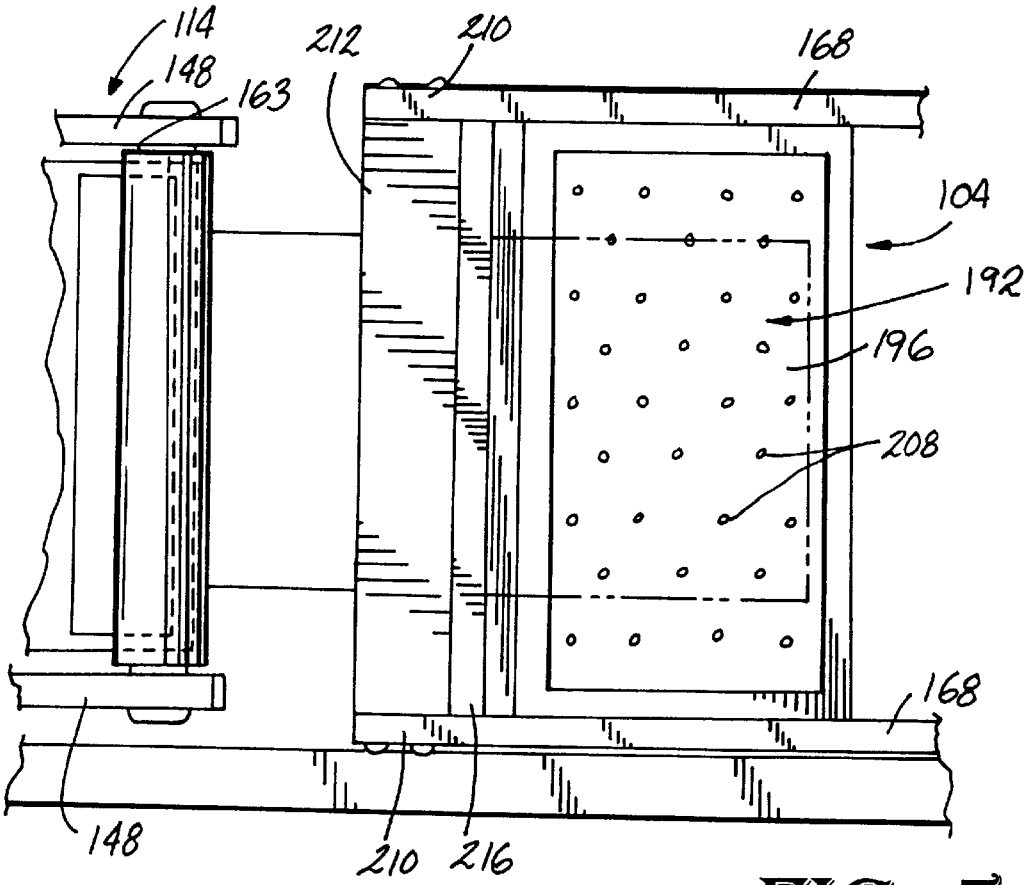
FIG. 5 is bottom view of the apparatus taken along lines 5—5 of FIG. 1.

Referring specifically to FIGS. 1,4 and 5, the applicator 104 comprises a housing 166 defined by a pair of sidewalls 168 interconnected by one or more transverse brace members 169 along a forward edge of the sidewalls 168 in which a cutter/applicator 174 is mounted for slidable vertical movement and which can be actuated by a conventional pneumatic cylinder 172. The cylinder includes brackets 173 at an upper portion and a lower portion (not shown) which is mounted to a sidewall 168 such as by welding.

An inner sidewall 168 includes a bearing mounting on a rear surface thereof which slidably mounts to a bearing member (not shown) on the exterior housing 101 so that the applicator 104 can be slid toward or away from the printer 102 for convenient access to parts of the applicator 104 for maintenance purposes. Further, the exterior housing 101 includes a cylindrical protrusion 103 which acts as a stop to limit the slidable movement of the applicator 104 with respect to the printer 102.

As depicted in FIG. 4, the cutter/applicator head 174 has a frontal surface of the body 176, an upper surface 178, and a lower surface 180. A blade 182 is fixably mounted to the frontal surface of the body 176 and defines an operational cutting edge 184 thereon. The upper surface 178 fixably mounts a distal end of an axial piston 186 of the pneumatic cylinder 172 so that the head 174 travels with any motion imparted to the piston 186 by the cylinder 172. Further, the upper surface 178 of the head 174 can further mount one or more shafts 188 which are received within sleeves 190 (FIG. 1) mounted to the sidewalls 168 by fasteners 191 engaged within apertures 193 of the housing 166 to further ensure that any motion imparted to the cutter/applicator head 174 relative to the sidewalls 168 is restricted to substantially vertical motion.

Referring specifically to FIGS. 4 and 5, the lower surface 180 of the head 174 mounts a vacuum head 192. The vacuum head 192 comprises a first plate 194 and a second plate 196 wherein the first plate 194 extends from the lower surface 180 and the second plate 196 is mounted to a lower surface of the first plate 194. The first plate 194 includes a recess 198 in its lower surface which is fluidly connected by a conduit 200 in the first plate 194 and a conduit 202 in the head 174 to a port 204 which cooperates to fluidly connect the recess 198 in the first plate 194 to the upper surface 178 of the head 174. The port 204 is adapted to receive one end of a flexible conduit 206 which is connected to a vacuum source.

The second plate 196 extends across the recess 198 in the first plate 194 and includes several ports 208 which cooperate to fluidly connect the recess 198 with the region immediately below the second plate 196 whereby, when the conduit 206 is connected to a vacuum source, the recess 198 acts as a distribution chamber to apply a vacuum to each of the ports 208 in the second plate 196, to support a label portion 106*a* on support surface 197.

Each sidewall 168 of the housing 166 includes a rearwardly-extending horizontal leg 210 between which a flange 212 is mounted which extends therebetween. A portion of the flange 212 adjacent a rearward vertical edge 214 of each sidewall 168 includes a blade 216 mounted to the flange 212 and is provided with an upper operational cutting edge 218 thereon. The flange 212 further includes a curved surface 220 which is adapted to receive the curved end surface 152 of the guide plate 114 when the applicator 104 is slid rearwardly to abut the printer 102. When the applicator 104 and the printer 102 are in abutting relationship, the label portion 106*a* of the web 106 extends in a horizontal tangential fashion over a lead roller 163 on the guide plate 114.

The cutter/applicator head 174 of the applicator 104 is slidably movable between an upper rest position and a lower operational position adjacent an object on which the label portion 106*a* is to be applied. As the label portion 106*a* is advanced beyond the print head 130, the label portion 106*a* extends between the sidewalls 168 of the housing 166 and beneath the cutter/applicator head 174 when the head 174 is in the upper rest position. When the label portion 106*a* is advanced a sufficient distance beneath the head 174, the cylinder 172 is actuated. This longitudinally extends the piston 186 mounted to the head 174 thereby urging the head 174 in a downward direction. The label portion 106*a* is severed from the remaining portion of the web 106 as the operational cutting edge 184 of the blade 182 is thrust downwardly immediately adjacent the operational cutting edge 218 of the blade 216. The label portion 106*a* is thereby retained against the vacuum ports 208 of the second plate 196 through the vacuum supply through the conduit 206, 202, and 200 to the recess 198. By a continued downward motion of the piston 186, the label portion 106*a* is urged downwardly and against an object (not shown) on which the label portion 106*a* is to be applied.

It will be understood that the cylinder 172 is preferably an air-operated cylinder provided with a return spring in which the piston 186 is actuated by application of air pressure and returned by the force of the return spring.

It will be further understood that printing and cutting/application steps are performed under control of a processor in a known fashion. The system may be provided with a detector (not shown) which detects the presence of an object to be labeled and sends an appropriate signal to the processor. The processor responds to the signal to actuate cutter/applicator head 174 to apply a label to the object, actuate the print head 130 to print a next label, and to control the advancing of a next printed label. In the normal sequence of operation, a leading edge portion of the web 106 will be manually inserted between the print head 130 and the body 146 of the guide plate 114. The web 106 will be advanced by control of a supply reel and a take-up reel (not shown in the drawing) to a proper position for printing. Subsequently, the strip will be advanced to the applicator 104 for cutting and application to an object as described. After the cutting step, the leading edge of the web 106 may be withdrawn a predefined distance such that the area of the web 106 designated for the next label is in alignment with the print head 130, and the next label section is printed. Alternatively, a first printed label may be partially advanced toward the cutter/applicator and a next successive label printed. After a next successive label has been printed, the leading edge of the web 106 is advanced so that the first printed label is ready to be cut from the web and applied to an object by the applicator 104.

It will be understood that the above-described arrangement is merely illustrative of the application of the principles of the invention and that other arrangements may be devised by those skilled in the art without departing from the scope of the invention as defined by the appendant claims.

What is claimed is:

1. A method of applying a label to an object, the method comprising the steps of:

providing a strip of web material and a printer having a leading edge and adapted to receive the strip of web material;

advancing the strip of web material to the printer and printing indicia on the web material;

providing a movable label applicator having a label receiving surface for receiving a section of the web material and having a cutting blade;

advancing a section of the web material from the printer to the label receiving surface;

moving the label applicator to the object and severing the section from the strip of web material by the cutting blade while the applicator is moved toward the object; and applying the severed section to the object.

2. Label application apparatus comprising:

a cutter/applicator housing having a frontal wall;

a first cutting blade fixedly mounted adjacent the frontal wall and having a cutting edge;

a cutter/applicator head movably supported by the housing and comprising a label support surface and a second cutting blade having a cutting edge and mounted on one side of the cutter/appplicator head adjacent the frontal wall, the cutting edge of the second cutting blade being aligned relative to the cutting edge of the first blade;and printer apparatus disposed on the one side of the housing adjacent the frontal wall and comprising a print head operative to print selected portions of label material and a guide for guiding a continuous web of label material between the first and second cutting blades to the label support surface;

an actuator for moving the cutter/applicator head from a first position on one side of the first cutting blade to a second position on another side of the first cutting blade and adjacent an object to be labeled while moving the second cutting blade past the first cutting blade, whereby movement of the cutter/applicator head from the first position to the second position causes a portion of the label material to be severed from the continuous web.

3. The apparatus in accordance with claim 2 and further comprising a mounting shaft mounted to one of the housing and the cutter/applicator head and a sleeve mounted to another of the housing and the cutter/applicator head for guiding the cutter/applicator head along a path wherein the first and second cutting blades are aligned for cutting the web of label material.

4. The apparatus in accordance with claim 2 wherein the printer apparatus comprises a printer roller for guiding the continuous web of label material past the first cutting blade and the cutter/applicator housing comprises a retainer flange disposed adjacent printer roller and the first cutting blade for retaining the first cutting blade and wherein the retainer flange comprises an inner surface disposed adjacent the cutting blade and a curved outer surface disposed adjacent the printer roller.

5. The apparatus in accordance with claim 4 wherein the printer roller is supported by a support bracket having a curved end surface disposed adjacent the curved outer surface of the retainer flange.

6. The apparatus in accordance with claim 2 wherein the label support surface comprises an outer wall provided with a plurality of orifices communicating with a vacuum chamber, whereby an end portion of the continuous web is retained adjacent the label support surface.

* * * * *